US008632171B2

(12) United States Patent
Henn et al.

(10) Patent No.: US 8,632,171 B2
(45) Date of Patent: Jan. 21, 2014

(54) INK CARTRIDGES AND OUTPUTTING INK FROM INK CARTRIDGES

(71) Applicant: Hewlett-Packard Indigo B.V., Amstelveen (NL)

(72) Inventors: Nissim Henn, Nes Ziona (IL); Chen Talmor, Givat ada (IL); Guy Fefferman, Tel Aviv (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 13/675,188

(22) Filed: Nov. 13, 2012

(65) Prior Publication Data

US 2013/0169719 A1 Jul. 4, 2013

Related U.S. Application Data

(63) Continuation-in-part of application No. 13/338,774, filed on Dec. 28, 2011.

(51) Int. Cl.
*B41J 2/175* (2006.01)

(52) U.S. Cl.
USPC ..... 347/86; 347/87

(58) Field of Classification Search
USPC ..... 347/86
See application file for complete search history.

(56) References Cited

U.S. PATENT DOCUMENTS

| | | | | |
|---|---|---|---|---|
| 2,920,797 | A * | 1/1960 | Sherbondy | 222/327 |
| 3,870,200 | A | 3/1975 | Spatz | |
| 4,852,772 | A | 8/1989 | Ennis, III | |
| 5,314,092 | A | 5/1994 | Jacobsen | |
| 5,489,927 | A * | 2/1996 | Harmon | 347/33 |
| 5,682,186 | A * | 10/1997 | Bohorquez et al. | 347/29 |
| 6,361,606 | B1 | 3/2002 | Jairazbhoy | |
| 6,382,472 | B1 | 5/2002 | Shoval | |
| 6,419,351 | B1 | 7/2002 | Lawson | |
| 6,517,185 | B1 * | 2/2003 | Aldrich | 347/29 |
| 6,725,769 | B1 | 4/2004 | Williams | |
| 2002/0044181 | A1 * | 4/2002 | Suenaga et al. | 347/85 |
| 2002/0080217 | A1 * | 6/2002 | Olsen | 347/93 |

FOREIGN PATENT DOCUMENTS

WO WO00/61489 A1 10/2000

* cited by examiner

*Primary Examiner* — Matthew Luu
*Assistant Examiner* — Alexander D Shenderov

(57) ABSTRACT

An ink cartridge has a container to contain ink and a valve member. The container has an outlet to output ink contained in the container. The valve member is moveable transverse to the outlet to open and close the outlet and carries a seal to seal the outlet when closed by the valve member.

14 Claims, 6 Drawing Sheets

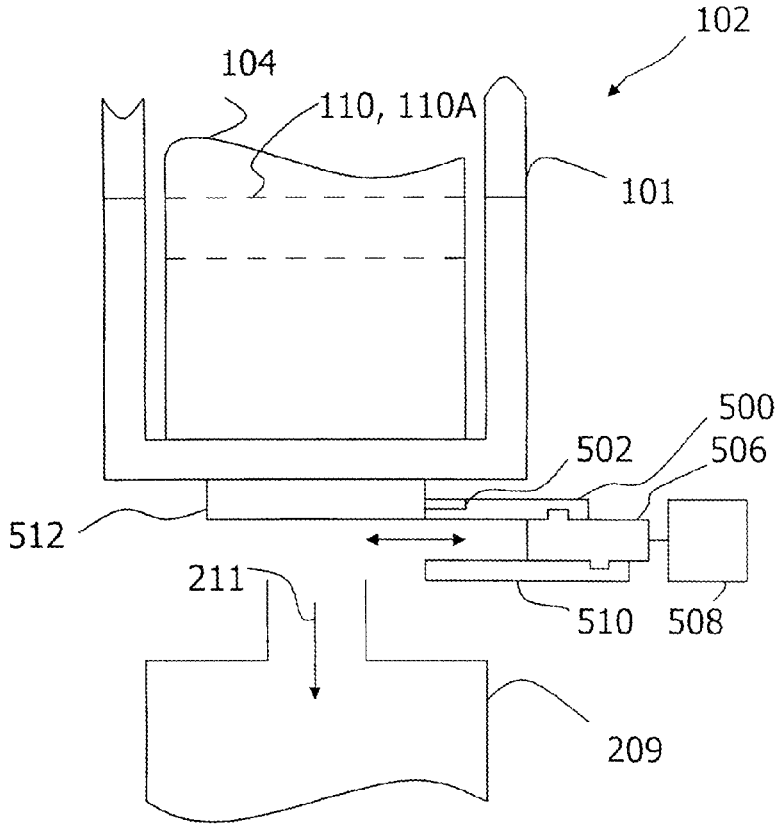
FIG. 7
FIG. 9
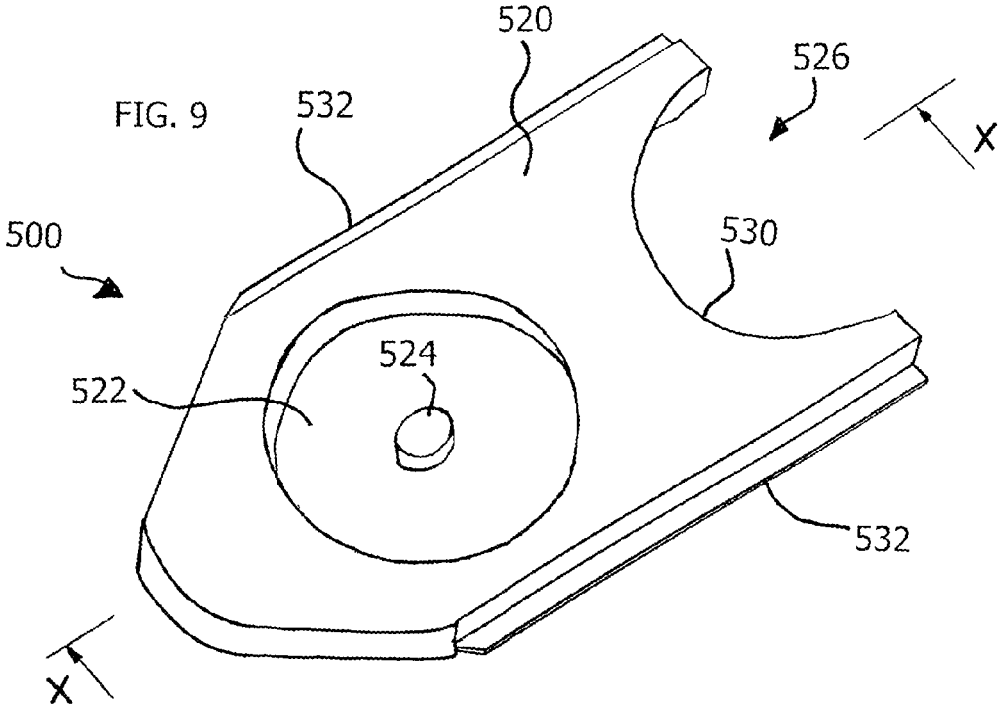

INK CARTRIDGES AND OUTPUTTING INK FROM INK CARTRIDGES

CROSS REFERENCE TO RELATED APPLICATION

This is a continuation-in-part of U.S. application Ser. No. 13/338,774, filed Dec. 28, 2011, which is hereby incorporated by reference.

BACKGROUND

A printer system can include an ink cartridge (or multiple ink cartridges) that contain(s) printer ink for use in printing onto substrates (e.g. paper, poster, transparency, etc). The printer system includes a mechanism to extract printer ink from each ink cartridge. The extracted printer ink is then delivered by a delivery assembly to a substrate to print a target pattern on the substrate.

BRIEF DESCRIPTION OF THE DRAWINGS

In the disclosure that follows reference will be made to the drawings in which:

FIG. 7 is an enlarged schematic view of an example of an implementation of a drive assembly and ink cartridge as shown in FIG. 1;

FIG. 9 is a perspective view of a valve member associated with the ink cartridge of FIG. 7;

DETAILED DESCRIPTION

An ink cartridge for use in a printer system includes a container that contains printer ink. During use, the printer ink in the ink cartridge can be extracted from an outlet of the ink cartridge. Multiple ink cartridges provided in a printer system can contain printer ink of different colors.

In certain types of printer systems, the printer ink can be relatively viscous (have a viscosity greater than some predefined threshold). An example of such a printer system is a Hewlett-Packard Indigo press system that employs printer ink that has relatively small solid color particles suspended in an oil (referred to as an imaging oil). An example imaging oil is an isoparaffinic fluid, such as Isopar™ fluid. In other examples, color particles can be suspended in other types of dispersion liquids. The viscosity of the printer ink used in a Hewlett-Packard Indigo press system depends upon the concentration of the solid color particles suspended in liquid. A higher concentration of the solid color particles in the ink cartridge leads to more viscous printer ink.

Note that the reference to Hewlett-Packard Indigo press systems is provided for simply as an example of a printer system that may utilise techniques, concepts or hardware disclosed herein. Techniques, concepts or hardware as disclosed herein can be used in other types of printer systems.

It can be challenging to fully extract relatively viscous ink from an ink cartridge in a uniform manner. The challenge becomes greater as the inner ink-containing volume of the ink cartridge increases. With traditional techniques or mechanisms, residual amounts of viscous printer ink can remain in the ink cartridge, which can lead to inefficient use of the ink cartridge.

In accordance with some implementations, techniques or mechanisms are provided to allow for more effective and uniform extraction of relatively viscous printer ink from an ink cartridge. By using such techniques or mechanisms, larger ink cartridges (with larger ink-containing volumes) can be employed to increase the printing capacity of a printer system.

Figure 1:
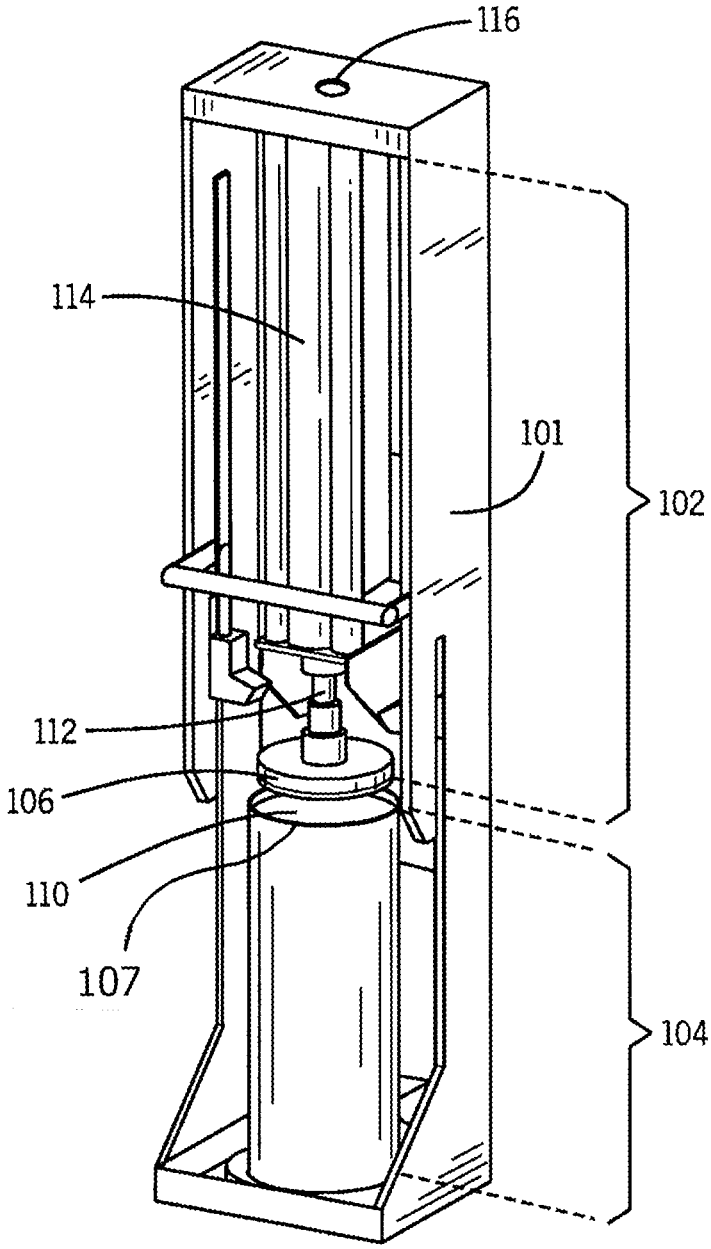
FIG. 1 is a perspective view of an arrangement that has a drive assembly and an ink cartridge according to some implementations.

In some implementations, a drive assembly is provided in a printer system for applying a force on a moveable plunger of an ink cartridge to more effectively extract printer ink from an ink cartridge. An example arrangement according to some implementations is shown in FIG. 1, which depicts a drive assembly 102 and an ink cartridge 104. In examples according to FIG. 1, the drive assembly 102 and ink cartridge 104 are positioned inside a support frame 101. In other examples, a similar support frame can be used to house multiple drive assemblies and respective ink cartridges. The ink cartridge 104 can be formed of a plastic or other material.

The drive assembly 102 has a drive head 106 that is used for engaging a cartridge plunger 110 in the ink cartridge 104. The drive head 106 can include at least one portion formed of a relatively soft resiliently deformable material, such as a material including elastomer. The plunger 110 can be formed of a relatively soft material, such as a material including elastomer. The ink cartridge 104 includes a container in which printer ink is contained. Downward movement of the cartridge plunger 110 due to a force applied by the drive head 106 causes the output, or delivery, of printer ink from an outlet (not shown in FIG. 1) at a lower, or delivery, end of the ink cartridge 104.

The drive assembly 102 further includes a drive rod 112. The lower end of the drive rod 112 is attached to the drive head 106. A piston (discussed further below in connection with FIG. 2) is provided inside a chamber defined by an outer housing 114 of the drive assembly 102. The piston is moveable by application of pneumatic pressure above the piston, such as due to application of pressurized gas (e.g. air) through a gas input port 116 that delivers gas into the upper portion of the chamber of the drive assembly housing 114.

In other examples, the piston in the drive assembly 102 can be driven by hydraulic pressure (due to application of pressurized liquid) or by a mechanical force (e.g. due to mechanical force applied by a motor). More generally, the piston in the drive assembly 102 is an actuating member that is moveable due to application of an input force such as pneumatic pressure, hydraulic pressure or mechanical force. In still further examples, the actuator for the drive head 106 need not include a piston. For example, an electric, hydraulic or pneumatic motor may be used to drive a drive rod, such as the drive rod 112, via a gear system such as a rack and pinion or worm and wheel. In other examples, the actuator for the drive head 106 may comprise a leadscrew.

Figure 2:
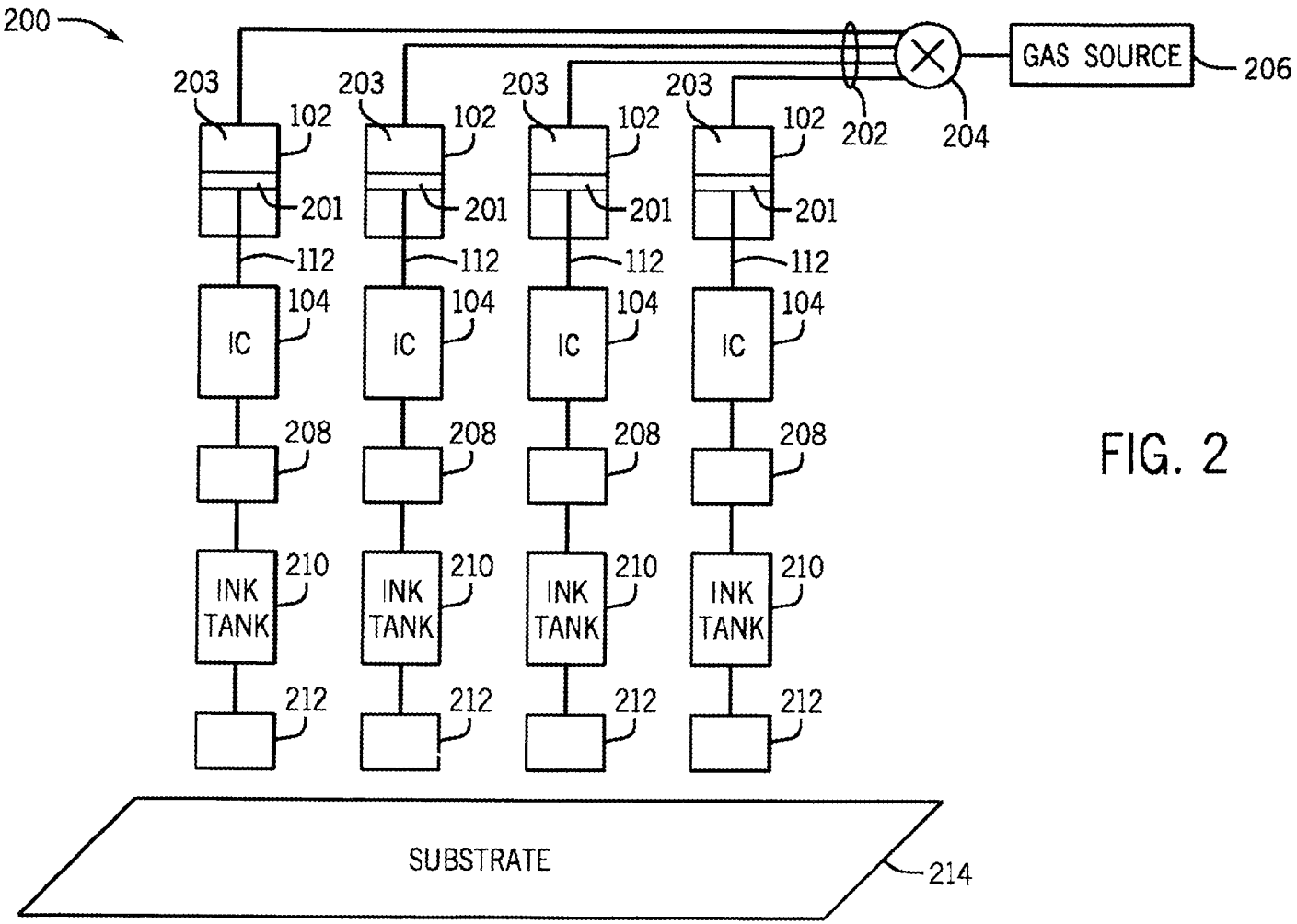
FIG. 2 is a block diagram of a portion of an example printer system incorporating drive assemblies and ink cartridges in accordance with some implementations.

FIG. 2 is a schematic view of an example printer system 200 that has multiple ink cartridges 104 (containing printer ink of different colors, for example) and corresponding drive assemblies 102. Note that FIG. 2 is intended to schematically illustrate some components that may be present in the printer system 200 and there may be other components not shown. The drive assemblies 102 are connected to respective pneumatic lines 202 for delivery of pressurized gas from a gas source 206 through a valve assembly 204 that can have various valves. The valves in the valve assembly 204 can be controlled to open and close. When in an open position, a valve allows gas from the gas source 206 to be delivered through the corresponding pneumatic line 202 to the corresponding drive assembly 102.

The pressurized gas delivered into an inner chamber 203 of a drive assembly 102 is able to drive a moveable piston 201 inside the drive assembly. The piston 201 is connected to a respective drive rod 112 (also shown in FIG. 1). The pressurized gas delivered into the inner chamber 203 applies a downward force on the piston 201 to push the piston 201 downwardly, which in turn moves the respective drive rod 112 of the drive assembly 102 downwardly to move the plunger 110 (FIG. 1) in the corresponding ink cartridge 104. The downward movement of the plunger 110 in the ink cartridge 104 causes printer ink to be output from the ink cartridge 104.

The printer ink that is output from each ink cartridge 104 is passed through a corresponding ink flow subsystem 208 for delivery to a respective ink tank 210. The ink flow subsystem 208 can include various components, including a mixing tank (to mix the printer ink extracted from the ink cartridge 104, such as by adding liquid to dilute the printer ink). The ink flow subsystem 208 in some examples can also include a pump and corresponding valve for controlling flow of the printer ink to the respective ink tank 210. In other examples, the mixing tank and/or the pump can be omitted from the ink flow subsystem 208.

The printer ink from the various ink tanks 210 may then in turn be delivered through a liquid electro-photographic print engine 212 onto a substrate 214 (e.g. paper, poster, transparency, etc.). In this manner, an image or target print pattern can be printed on the substrate 214. Effectively, the ink flow subsystem 208, ink tank 210 and liquid electro-photographic print engine 212 are part of an example ink delivery assembly for delivering printer ink from an ink cartridge 104 to the substrate 214. As is known to those skilled in the art, a liquid electro-photographic print engine may comprise binary ink developers that are able to develop an electrostatic latent image created on a photoconductor drum and from which the developed image is transferred to an intermediate transfer member (ITM) that transfers the image to a substrate. In other examples, other implementations of an ink delivery assembly can be employed for delivering printer ink extracted from an ink cartridge to a substrate.

Figure 3:
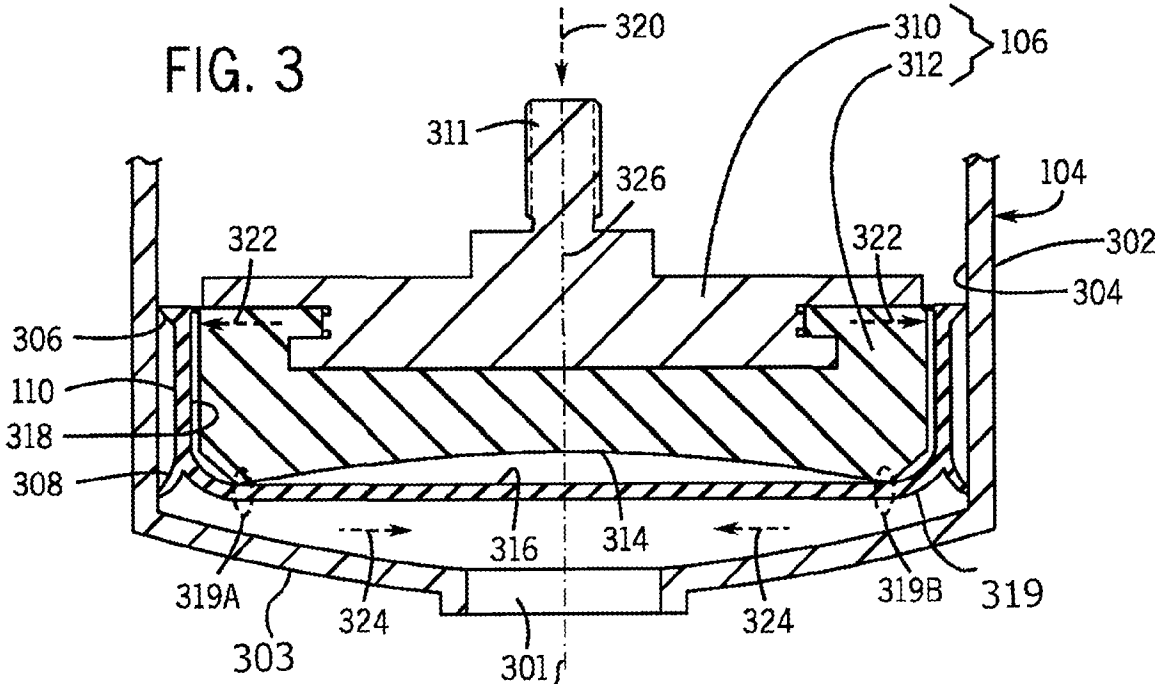
FIG. 3 is a cross-sectional view of portions of a drive assembly and ink cartridge according to some implementations.

FIG. 3 is a cross-sectional view of portions of the drive assembly 102 and the ink cartridge 104. FIG. 3 shows a portion of a cylindrical side wall 302 of the ink cartridge 104. The side wall 302 is closed at one end by an end wall 303. The side wall 302 and end wall 303 form a container 304 of the ink cartridge 104. The end wall 303 tapers outwardly towards the center thereof. The center of the end wall 303 is coincident with a longitudinal axis, or center line, 326 of the ink cartridge 104. An outlet 301 is provided in the center of the end wall 303. Ink can be output from the ink cartridge via the outlet 301 in response to movement of the plunger 110 towards the outlet. In FIG. 3, the cartridge plunger 110 is shown in a lowered position inside the container 304. The plunger 110 has been moved to its lowered position by downward movement of the drive head 106.

The plunger 110 may comprise a generally cup-like body having an annular side wall 318 and a generally planar transverse end wall 319 disposed towards one end of the side wall. The plunger 110 has sealing lips 306, 308 that extend from the side wall 318 to seal against the inner side of the side wall 302 of the container 304. When sealingly engaged with the inner side of the container side wall 302, the sealing lips 306, 308 prevent printer ink from leaking from a lower portion of the ink cartridge 104 past the plunger 110 to an upper portion of the ink cartridge 104 as the plunger 110 is pushed downwardly by the drive head 106.

In accordance with some implementations, the drive head 106 includes a rigid core, or backing member, 310, which can be formed of a relatively sturdy, or stiff, material such as metal, engineering plastics or another material. In addition, the drive head 106 has a deformable pressure member 312 that is attached to the rigid core 310. The pressure member 312 is positioned below the rigid core 310. A bottom surface 314 of the pressure member 312 is arranged to engage an opposing (upper) surface 316 of the end wall 319 of the plunger 110. In examples according to FIG. 3, the cup-like body of the plunger 110 defined by the side wall 318 and end wall 319 provides a receptacle that receives at least a portion of the drive head 106. As depicted in FIG. 3, the pressure member 312 is positioned inside the plunger receptacle.

In some examples, the pressure member 312 is formed of material that includes an elastomer. Examples of an elastomer include polyurethane, flouropolymer elastomer, rubber, and so forth. In other examples, the pressure member 312 can be formed of other deformable materials.

In accordance with some implementations, the bottom surface 314 of the drive head pressure member 312 is concave in shape when viewed from below the pressure member. In examples, such as that shown in FIG. 3, the upper surface 316 of the plunger end wall 319 110 is generally planar such that contact between the pressure member 312 and the upper surface 316 occurs on an annular contact area indicated by locations 319A, 319B. However, in other examples, the upper surface 316 of the plunger end wall 319 can have other shapes, one of which is discussed further below in connection with FIG. 4.

The drive head rigid core 310 has an attachment member 311 that is for attaching to the drive rod 112 depicted in FIG. 1. In some examples, the external surface of the attachment member 311 has a thread profile to allow for threading engagement with the drive rod 112. In other examples, the attachment member 311 can be engaged to the drive rod 112 using another type of attachment mechanism, such as by using a screw, nut and bolt mechanism, bayonet fitting and so forth.

In operation, a downwardly directed drive force is applied to the drive head 106 via the drive rod 112 as indicated by arrow 320. This drive force 320 on the drive head 106 and an opposing force, that is due to resistance to movement of the ink contained in the container 304, puts the pressure member 312 into compression, which causes it to deform generally radially outwardly and impart an outward radial force (indicated by arrows 322) against the plunger 110. This outward radial force applied against the plunger 110 improves sealing engagement between the sealing lip 306 of the plunger 110 and the inner side of the container side wall 302.

Initially, when the plunger 110 is located at an elevated position in the ink cartridge container 304 remote from the outlet 301 (such as when it is located adjacent the free end 107 of the container side wall as shown in FIG. 1), the ink contained in the container 304 provides a relatively low resistance to downward movement of the plunger so that most of the drive force 320 is applied to the annular contact area on the upper surface 316 of the plunger end wall 319 that is indicated by the locations 319A, 319B in FIG. 3. However, once the plunger 110 has moved down to its lowered position, as shown in FIG. 3, and after most of the printer ink has been extracted from the ink cartridge 104 through the outlet 301, the force opposing downward movement of the plunger increases rapidly. Consequently, continued application of the downward drive force 320 causes further compression of the pressure member 312 that causes the bottom surface 314 to become progressively less concave, thereby increasing the area of contact between the bottom surface and the surface 316 of the plunger end wall 319. If there is sufficient resistance to downward movement of the plunger 110, the deformation of the pressure member 312 will be such that the bottom surface 314 becomes convex. The plunger end wall 319 has sufficient flexibility to allow it to deform in response to the bottom surface 314 of the pressure member 312 becoming convex so that the surface of the plunger end wall engaging the ink also becomes convex. As the surface of the plunger end wall 319 engaging the ink becomes convex, it causes the remaining printer ink to move towards the center line 326 of the ink cartridge 104, as indicated by arrows 324. Such inward pressure indicated by arrows 324 is due to the concave shape of the bottom surface 314 of the pressure member 312 becoming progressively convex and deforming the end wall 319 of the plunger to produce a pressure wavefront that moves towards the center line 326 of the ink cartridge 104 when the ink cartridge is almost empty.

The ability to apply inward pressure provides a squeeze effect against remaining portions of printer ink as the plunger 110 is moved to its lowered position, which allows for more effective extraction of the printer ink from the ink cartridge 104.

Figure 4:
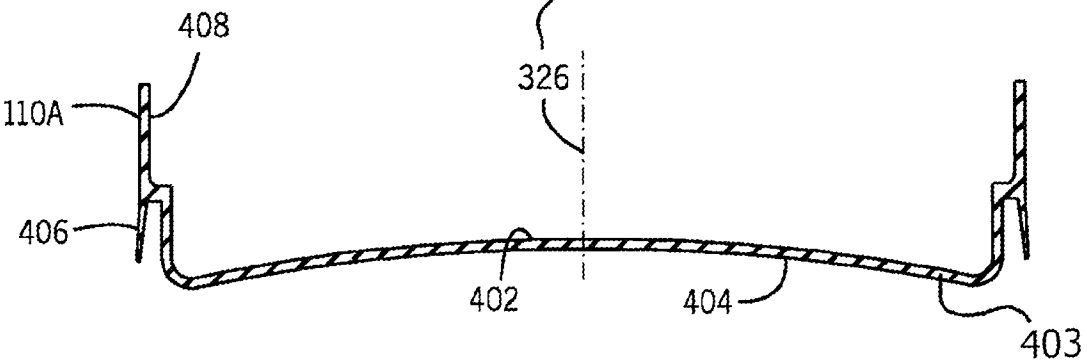
FIG. 4 is a cross-sectional view of a plunger for use in an ink cartridge according to alternative implementations.

As noted above, FIG. 3 shows an example arrangement in which the upper surface 316 of the plunger end wall 319 is generally planar. In alternative implementations, as depicted in FIG. 4, a plunger 110A can have a different shape. The upper surface 402 (upper surface) of the transverse end wall 403 of plunger 110A is convex (when viewed from the top of the plunger 110A). The convex upper surface 402 has a profile that generally matches the concave profile of the bottom surface 314 of the drive head 106 shown in FIG. 3 such that the bottom surface 314 of the drive head and opposed surface 402 mate when the drive head engages the plunger 110A.

The end wall 403 of the plunger 110A has a bottom surface 404 (the surface that contacts the printer ink in the ink cartridge 104) that is generally concave when viewed from the bottom of the plunger 110A. The curved profile of the end wall 403 of the plunger 110A allows for enhanced extraction of printer ink from the ink cartridge 104, since the curved profile can change to a different profile to provide a squeeze action due to pressure applied inwardly towards the center line 326. In some implementations, the curved profile of the end wall 403 is deformed such that the bottom surface 404 transforms from concave to convex.

As further shown in FIG. 4, the plunger 110A has a sealing lip 406 that is to sealingly engage the inner wall of the ink cartridge outer housing 302. As with the plunger 110 shown in FIG. 3, the plunger 110A also defines a receptacle 408 in which the drive head 106 of the FIG. 3 can be received.

Figure 5:
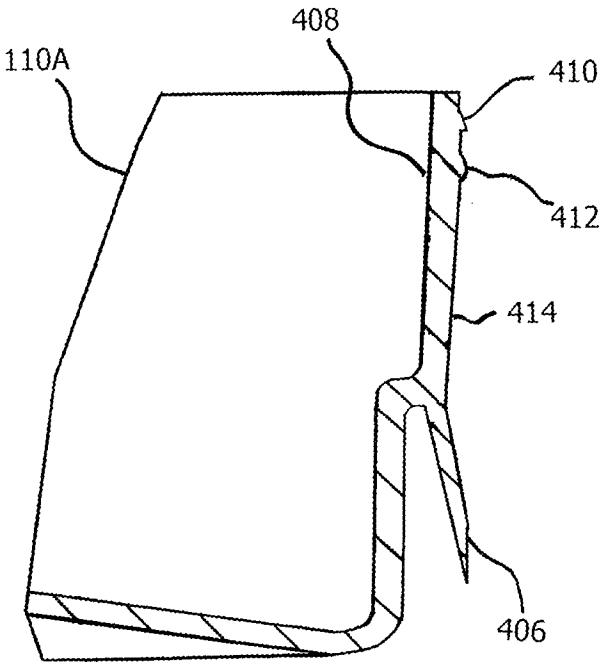
FIG. 5 is a cross-sectional view showing a modification of the plunger shown in FIG. 4.

As shown in FIG. 5, the plunger 110A may be modified to include two sealing rings 410, 412 that are provided on an annular side wall 414 of the plunger. The first sealing ring 410 is disposed adjacent an upper end of the side wall 414 that defines the entry to the receptacle 408. The first sealing ring 410 has a generally triangular profile. The second sealing ring 412 is disposed intermediate the sealing lip 406 and first sealing ring 410. The second sealing ring 412 may have a generally arcuate profile and in the illustrated example has an approximately semi-circular profile. The relatively rigid first sealing ring 410 and the sealing lip 406 provide support and guidance for the modified plunger 110A. The sealing lip 406 is the main seal of the plunger and may be configured to be more flexible than the sealing lips 308, 406 of the examples shown in FIGS. 3 and 4. This may make the plunger 110A better able to cope with variations in the inner diameter of the side wall 302 of the container 304. Such variations may be caused by manufacturing tolerances or swelling of the ink contained in the container. The second sealing ring 412 provides a back up to the sealing lip 406 to catch ink that may get past the sealing lip 406.

Figure 6:
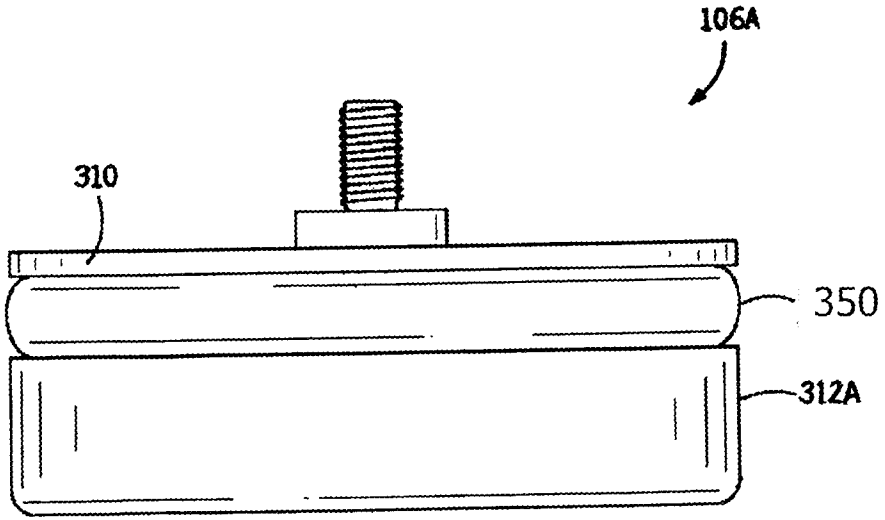
FIG. 6 is a side view of a drive head of a drive assembly according to further implementations.

FIG. 6 depicts a drive head 106A according to alternative implementations. The drive head 106A has a rigid core 310 (similar to the rigid core 310 of FIG. 3). The drive head 106A further has an O-ring seal 350 and a pressure member 312A. The O-ring seal 350 and the pressure member 312A can be formed of different materials (such as different elastomers), or can be formed of the same material. In arrangements using the drive head 106A, the outward radial force (322 shown in FIG. 3) applied by the drive head 106A (against the plunger 110 shown in FIG. 3 for example) is applied by the O-ring 350 instead of by the pressure member 312A. The bottom surface of the pressure member 312A can be concave-shaped, similar to the bottom surface 314 of the pressure member 312 of FIG. 3.

Figure 8:
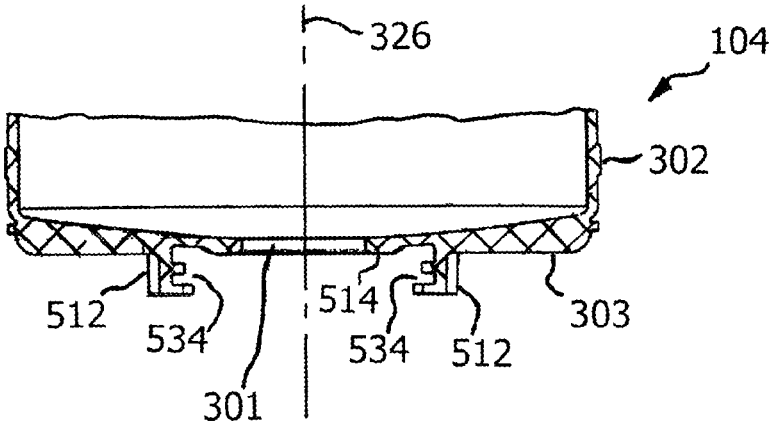
FIG. 8 is a cross-section view of an end of the ink cartridge of FIG. 7.

Referring to FIGS. 7 and 8, an output, or delivery, end of an ink cartridge, for example the ink cartridge 104, is shown supported by a support frame similar to or the same as the support frame 101 described above. The outlet 301 of the ink cartridge 104 (FIG. 8) is arranged to output ink into an ink flow subsystem as indicated by arrow 211 (FIG. 7). In the illustrated example the ink flow subsystem comprises a mixing tank 209 that receives the ink output by the ink cartridge. As previously indicated, the ink from the ink cartridge may be output to another receptacle such as an ink tank 210 (FIG. 2). As previously described, ink is caused to flow from the ink cartridge 104 in response to movement of the ink cartridge plunger towards the outlet 301. The plunger may be a plunger 110, 110A as shown in FIGS. 3 to 5.

The ink cartridge 104 is provided with a valve comprising a valve member 500 and a seal 502 carried by the valve member. The valve member 500 is moveable transverse to the outlet 301 to open and close the outlet. The seal 502 is configured to seal the outlet when the outlet is closed by the valve member. In the illustrated example the valve member 500 moves along a path that is disposed perpendicular to the center line 326 of the ink cartridge container 304. A trailing end 503 of the valve member 500 includes a recess 504 (FIG. 10) that receives a projection provided on a slider 506. The projection may be an integral formation of the slider 506 or a separate body such as, for example, the head of a screw that is screwed into the slider. The slider 506 is connected with an actuator 508 arranged to cause reciprocating movement of the slider. The actuator may, for example, be a pneumatic or hydraulic cylinder, a leadscrew, rack and pinion system or any actuator system capable of causing reciprocating movement of the slider.

The slider 506 is provided with a second projection that is received in a recess provided in a cover 510. The second projection may be an integral formation of the slider 506 or may be a separate body such as, for example, the head of a screw screwed into the slider. The cover 510 is disposed in parallel spaced apart relation to the valve member 500 and reciprocates with the valve member when the valve member is driven by the actuator 508. When the valve member 500 is advanced by the actuator to close the outlet 301, the cover 510 is simultaneously advanced to cover the inlet to the mixing tank 209. The cover 510 is shorter than, or set back with respect to, the valve member 500 so that the valve member advances ahead of the cover and closes the outlet 301 before the inlet to the mixing tank 209 is covered.

In the illustrated example the slider 506 is connected with the valve member 500 and cover 510 by means of projections received in respective recesses in the valve member and cover. However, the parts may be connected in other ways. For example, one or both of the valve member and cover may be provided with a projection that is received in a suitable recess associated with the slider. In other examples, the valve member or cover may be provided with a snap-fit formation to snap-fit connect to the slider or the slider may be provided with a snap-fit formation to snap-fit connect to the valve member or cover. In still further examples, conventional fasteners such as screws may be used to make the connection.

The output, or delivery, end of the ink cartridge 104 is provided with a support formation 512 to support the valve member 500. In the illustrated example, the support formation 512 comprises two rails that are disposed in parallel spaced apart relation with the outlet 301 disposed between them. Although not essential, in the illustrated example the support formation 512 is an integral part of the end wall 303 of the ink cartridge 104. The end wall 303 defines an annular land 514 surrounding the outlet 301 and also disposed between the rails of the support formation 512.

Figure 10:
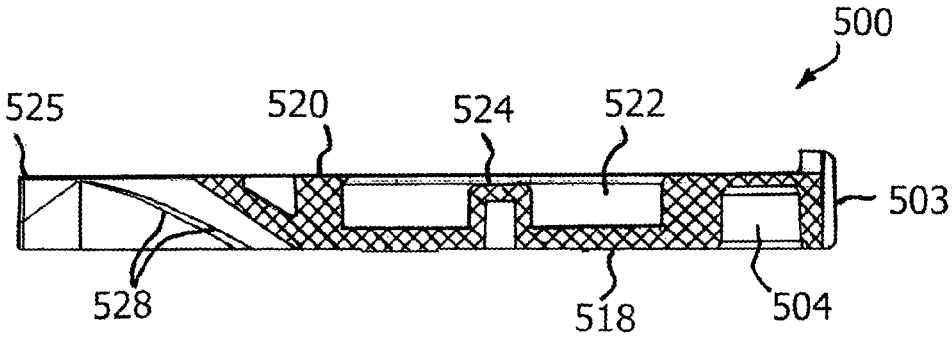
FIG. 10 is a cross section on line X-X in FIG. 9.

Referring to FIGS. 9 and 10, the valve member 500 is an elongate member that may, for example, be a plastics molding. The recess 504 that receives the projection provided on the slider 506 is provided in a major face 518 of the valve member that faces away from the end wall 303 of the ink cartridge. The opposite major face 520 of the valve member 500 faces the end wall 303 and is provided with a recess 522 to receive the seal 502. A locating projection 524 is provided in the recess 522. In the illustrated example, the locating projection 524 is a circular boss disposed in the axial center of the recess 522.

The leading end 525 of the valve member 500 is provided with an arcuate recess 526. As shown in FIG. 10, a second arcuate recess 528 is formed in the major face 518 of the valve member behind the arcuate recess 526. The second arcuate recess 528 curves between as it extends between the two major faces 518, 520 and transverse to the longitudinal axis, or center line, of the valve member that is indicated by the line X-X in FIG. 9. The second arcuate recess 528 merges with arcuate recess 526 to provide an arcuate undercut behind the arcuate recess 526 so that the curve of the arcuate recess 526 defines a cutting edge 530 at the major face 520.

The valve member 500 is provided with side members 532 that extend along opposite sides of the valve member. The side members 532 extend in parallel and are configured to slidingly engage in respective grooves 534 defined by the rails of the support formation 512. The cooperable engagement of the side members 532 and grooves 534 of the support formation 512 is such that the valve member 500 is guided by the support formation when moved to open and close the outlet 301.

Figure 11:
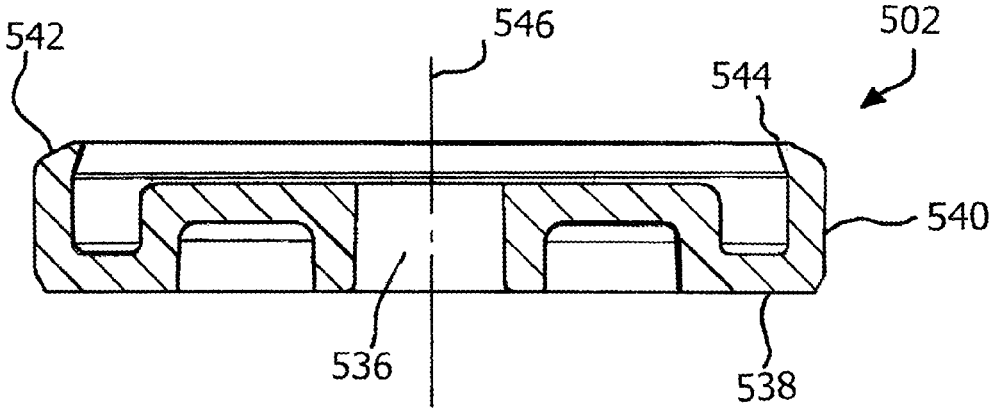
FIG. 11 is a cross-section of a seal associated with the valve member of FIGS. 9 and 10.

Referring to FIG. 11, the seal 502 has circular body provided with an axially disposed opening 536 to receive the locating projection 524 of the valve member. The opening 536 may be smaller than the locating projection 524 so that the seal is an interference fit with the locating projection to hold the seal in the recess 522 such that it will not be pulled from the recess when the valve member is moved to open and close the outlet 301.

The seal 502 has a base 538 to seat on the bottom surface of the recess 522 of the valve member 500. The opposite face of the seal is recessed to define an upstanding annular side wall 540. An annular lip 542 projects from the end of the side wall 540 remote from the base 538. The annular lip 542 has a generally triangular cross-section. The apex of the triangle defines a free end 544 of the annular lip 542. The radially outer side of the annular side wall 540 defines an outer periphery of the seal 502. The free end 544 of the annular lip 542 points inwardly of the outer periphery of the seal. The free end 544 of the annular lip 542 additionally points away from the base 538 of the seal so that as viewed in the drawing, the annular lip projects upwardly and inwardly of the side wall 540 towards the central axis 546 of the seal. When the seal 502 is seated in the recess 522, at least a portion of the annular lip 542 projects beyond the major face 520 of the valve member 500 so as to be able to engage the annular land 514 that surrounds the outlet 301. The configuration of the seal 502 may be such that only the annular lip 542 projects above the major face 520 of the valve member.

In the illustrated example, the annular sealing lip 542 has a triangular cross-section that projects from the upstanding side wall 540 of the seal 502. In other implementations the annular sealing lip may have a different cross-section shape. In implementations in which the seal has an annular sealing lip, the sealing lip may project from an upstanding wall of the seal as shown in FIG. 11. The projecting annular sealing lip may be configured such that it is deflected towards the base 538 of the seal 502 when engaged with the annular land 514 of the container 304. By making the seal, or at least the side wall and annular lip, of a suitably resilient material, this deflection may cause the annular lip to be loaded against the annular land to provide a firm seal. Furthermore, should the end wall 303 of the container deform outwardly, for example, due to swelling of the ink it contains, this will increase the force loading the annular lip against the annular land 514 thereby assisting in maintaining the integrity of the seal, even in adverse operating conditions. Furthermore, providing a seal configuration that allows for deflection of the part(s) of the seal that engage the annular land may facilitate sliding movement of the annular sealing lip over the annular land 514 as the valve member 500 slides back and forth to open and close the outlet.

The valve member may be made of a suitably rigid material such as a metal or a plastics material. The valve member may, for example, be a plastics molding made from a thermosetting plastic or a thermoplastic. The seal may be made of a suitably resilient material such as an elastomer.

In use, the ink cartridge 104 is fitted into the support frame 101 and the recess 504 in the valve member 500 is engaged with the projection provided on the slider 506. When ink is to be output from the ink cartridge 104 to the mixing tank 209, the actuator 508 is caused to retract the slider 506 (move it from left to right as viewed in FIG. 7). This draws the valve member 500 and seal 502 away from the outlet 301 by a sliding movement that is transverse to the center line of the outlet 301, which in the illustrated example is coincident with the center line 326 of the container 304. The operation of the slider 506 to retract the valve member 500 also causes the cover 510 to be retracted so as to open the inlet to the mixing tank 209. The sliding engagement of the side members 532 in the grooves 534 guides and supports the valve member 500 as it is retracted by the slider 506. When the valve member 500 is fully retracted, the outlet 301 is fully open and ink can be output from the ink cartridge 104 in response to movement of the plunger 110, 110A towards the outlet caused by a drive assembly such as the drive assembly 102.

When the output, or supply, of ink from the ink cartridge 104 is no longer required, the outlet 301 is closed by extending the valve member 500 to a closed position (movement from right to left as viewed in FIG. 7). The valve member 500 is extended by a movement of the slider 506 caused by the actuator 508. As the leading end 525 of the valve member 500 advances over the outlet 301, the cutting edge 530 engages any ink that depend from the outlet. This is most likely to occur when the container 304 contains a relatively more viscous ink. Because the cover 510 is not as advanced in the closing direction as the valve member 500, the ink severed by the advancing cutting edge 530 is able to fall into the mixing tank 209. When the valve member 500 has been extended to a closed position, the annular lip 542 sealingly engages the annular land 514 that surrounds the outlet 301 thereby sealing the outlet and the cover 510 covers the inlet to the mixing tank 209. The valve 500 can be operated to repeatedly open and close the outlet 301 in accordance with demand from a printer system such as the printer system shown in FIG. 2.

By using drive heads and plungers according to various implementations discussed, effective and uniform extraction of relatively viscous printer ink can be achieved. The drive head and plunger designs allow for improved sealing engagement between the plunger and the inner side of the container side wall (such as due to the outward radial force 322 depicted in FIG. 3), which can result in reduced ink accumulation on the container side wall. Additionally, the squeeze action provided by deformation of the plunger allows for increased extraction of printer ink from the ink cartridge, which leads to more efficient use of the printer ink. When a plunger with a fixed profile approaches relatively close to the end wall of the cartridge when nearly all of the ink has been output, the force required to move the plunger closer to the end of the wall increases significantly as the effect tends to be to simply compress the remaining ink between the plunger and end wall and not to move it towards the container outlet. The effect of the generally progressively radially inwards moving deformation of the plunger as it transforms from a non-convex to convex profile is to apply a force that sweeps the ink radially inwardly towards the container outlet.

Also, in some examples, due to use of a relatively soft material (such as elastomer) in the drive head and/or plunger, improved pressure distribution on the plunger's bottom surface is provided, which eliminates or reduces stress concentrations and plunger failures. Also, this latter feature enhances cartridge reliability, and also allows a thinner plunger to be used, which can reduce cartridge cost.

The ink cartridge may comprise just four components: the container, the plunger, the valve member and the seal. These parts may all be manufactured from a plastics material by a molding process such as injection molding. This makes it possible to manufacture ink cartridges with low unit costs. The valve member and seal may even be co-molded (double-shot injection molded), which may increase production and cost efficiency.

Making the ink cartridge from a plastics material may make the cartridge more durable and yield improvements in both reliability and re-usability. Known cartridges have a container made of metal are frequently dented during manufacture and subsequent handling. This may affect the effective output of ink from the cartridge and render it unsuitable for subsequent re-use. A plastics container may not be so susceptible to damage, particularly denting, making the cartridge more reliable in use and improving the potential to refill and re-use the container.

Forming a good seal between the plunger and container side wall may lead to a more effective delivery of ink from the ink cartridge by ensuring that ink does not get past the plunger as the plunger moves towards the outlet and reducing or eliminating residue ink left on the inner side of the container side wall. A container made of a plastics material may be susceptible to deformation due to swelling of oil in a bi-phase printer ink. Also, the tolerances on a plastics container may greater than for a metal container. Providing a radially outwardly directed force to the plunger that presses the plunger sealing lips or sealing rings against the container side wall may reduce or eliminate this problem, should it occur.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

The invention claimed is:

1. An ink cartridge comprising:

a container to contain ink and having an outlet to output ink from said container; and a valve comprising:

a valve member that is slideable transverse to said outlet to open and close said outlet, and a seal carried by said valve member to seal said outlet when closed by said valve member, wherein said seal comprises an annular lip configured to seal around said outlet and said annular lip is slidingly engageable with a land of the container, said annular lip slideable transverse to said outlet.

2. An ink cartridge as claimed in claim 1, wherein said annular lip has a triangular cross-section.

3. An ink cartridge as claimed in claim 2, wherein an apex of said triangular cross-section defines a free end of said annular lip and said free end points inwardly of an outer periphery of said seal.

4. An ink cartridge as claimed in claim 3, wherein said seal has a base surface to seat on said valve member and said free end points away from said base surface.

5. An ink cartridge as claimed in claim 1, wherein said annular lip is resiliently deflectable, and said annular lip is configured to be deflected by engagement with said container when sealing said outlet.

6. An ink cartridge as claimed in claim 1, wherein said valve member includes a cutter to cut through residue ink depending from said outlet when said valve member is moved to close said outlet.

7. An ink cartridge as claimed in claim 6, wherein said cutter has an arcuate cutting edge.

8. An ink cartridge as claimed in claim 1, wherein said container is defined by a cylindrical side wall and an end wall provided at an end region of said side wall, said outlet is provided in said end wall and said end wall is provided with a support formation to support said valve member when said valve member is in a position in which said valve member closes said outlet.

9. An ink cartridge as claimed in claim 8, wherein said valve member comprises side members to interengage said support formation and said support formation is configured to cooperate with said side members to guide said valve member when said valve member is moved to open and close said outlet.

10. An ink cartridge as claimed in claim 1, further comprising:

a plunger disposed in said container and moveable towards said outlet to force ink contained in said container through said outlet, wherein said plunger comprises a transverse wall that faces said outlet to engage ink contained in said container and is deformable from a non-convex condition to a convex condition whereby portions of said transverse wall move towards said outlet.

11. An ink cartridge as claimed in claim 1, wherein said valve member is slideable along a path that is generally perpendicular to a center line of the container, the center line passing through said outlet.

12. An ink cartridge as claimed in claim 1, wherein the land is an annular land.

13. An ink cartridge as claimed in claim 1, wherein said valve member includes a recess, and wherein said seal sits in said recess.

14. An ink cartridge as claimed in claim 13, wherein said valve member includes a locating projection in said recess, and said seal has an opening receiving said locating projection.

* * * * *